US010215062B2

(12) United States Patent
Lia

(10) Patent No.: US 10,215,062 B2
(45) Date of Patent: Feb. 26, 2019

(54) SWITCHING ROCKER ARM ASSEMBLY HAVING SPRING RETAINING CONFIGURATION

(71) Applicant: Eaton Corporation, Cleveland, OH (US)

(72) Inventor: Luigi Lia, Turin (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/401,351

(22) Filed: Jan. 9, 2017

(65) Prior Publication Data

US 2017/0114674 A1 Apr. 27, 2017

Related U.S. Application Data

(63) Continuation of application No. PCT/US2015/039344, filed on Jul. 7, 2015.
(Continued)

(51) Int. Cl.
*F01L 1/18* (2006.01)
*F01L 13/00* (2006.01)
*F01L 1/24* (2006.01)

(52) U.S. Cl.
CPC ..... *F01L 1/185* (2013.01); *F01L 1/18* (2013.01); *F01L 13/0005* (2013.01);
(Continued)

(58) Field of Classification Search
CPC ... F01L 1/185; F01L 13/0036; F01L 13/0005; F01L 2001/186; F01L 1/18;
(Continued)

(56) References Cited

U.S. PATENT DOCUMENTS 8,215,275 B2 7/2012 Church
2011/0126787 A1 6/2011 Kirbach
(Continued)

FOREIGN PATENT DOCUMENTS

DE 102012220216 A1 5/2014
WO 03042506 A1 5/2003

OTHER PUBLICATIONS

International Search Report and Written Opinion for International Application No. PCT/US2015/039344 dated Oct. 26, 2015, 13 pages.

(Continued)

*Primary Examiner* — Mark A Laurenzi
*Assistant Examiner* — Wesley G Harris
(74) *Attorney, Agent, or Firm* — RMCK Law Group PLC

(57) ABSTRACT

A switching rocker arm assembly constructed in accordance to one example of the present disclosure includes an outer arm, an inner arm, a bearing axle, and a first and second torsional bearing axle spring. The outer arm has a first outer side arm and a second outer side arm. The outer arm further includes a first tang extending from the first outer side arm and a second tang extending from the second outer side arm. The outer arm defines a first slot inboard of the first tang and a second slot inboard of the second tang. The first torsional bearing axle spring is mounted around a first torsional spring boss and has a first end nestingly received at the first slot and a second end engaged to the bearing axle. The first ends of the first and second torsional springs are laterally constrained by the respective first and second tangs.

20 Claims, 5 Drawing Sheets

Related U.S. Application Data

(60) Provisional application No. 62/021,380, filed on Jul. 7, 2014.

(52) U.S. Cl.
CPC ..... *F01L 13/0015* (2013.01); *F01L 13/0036* (2013.01); *F01L 1/2405* (2013.01); *F01L 2001/186* (2013.01); *F01L 2103/00* (2013.01); *F01L 2105/00* (2013.01); *F01L 2820/00* (2013.01); *Y10T 74/20882* (2015.01); *Y10T 74/2107* (2015.01)

(58) Field of Classification Search
CPC ..... F01L 2105/00; F01L 13/0015; Y10T 74/20882; Y10T 74/2107
See application file for complete search history.

(56) References Cited

U.S. PATENT DOCUMENTS

| | | | | |
|---|---|---|---|---|
| 2012/0037107 | A1* | 2/2012 | Church | F01L 1/185 123/90.41 |
| 2013/0000582 | A1 | 1/2013 | Church | |
| 2013/0186358 | A1* | 7/2013 | Manther | F01L 1/185 123/90.44 |
| 2013/0220250 | A1 | 8/2013 | Gunnel et al. | |

OTHER PUBLICATIONS

European Search Report for EP Application No. 15 818 304.6, dated Mar. 14, 2018, 9 pages.

* cited by examiner

SWITCHING ROCKER ARM ASSEMBLY HAVING SPRING RETAINING CONFIGURATION

CROSS-REFERENCE TO RELATED APPLICATIONS

This application is a continuation of International Application No. PCT/US2015/039344 filed Jul. 7, 2015, which claims the benefit of U.S. Patent Application No. 62/021,380 filed on Jul. 7, 2014. The disclosure of the above application is incorporated herein by reference.

FIELD

The present disclosure relates generally to switching roller finger followers or rocker arms in internal combustion engines.

BACKGROUND

Variable valve actuation (VVA) technologies have been introduced and documented. One VVA device may be a variable valve lift (VVL) system, a cylinder deactivation (CDA) system such as that described in U.S. Pat. No. 8,215,275 entitled "Single Lobe Deactivating Rocker Arm" hereby incorporated by reference in its entirety, or other valve actuation systems. Such mechanisms are developed to improve performance, fuel economy, and/or reduce emissions of the engine. Several types of the VVA rocker arm assemblies include an inner rocker arm within an outer rocker arm that are biased together with torsion springs.

Switching rocker arms allow for control of valve actuation by alternating between latched and unlatched states. A latch, when in a latched position causes both the inner and outer rocker arms to move as a single unit. When unlatched, the rocker arms are allowed to move independent of each other. In some circumstances, these arms can engage different cam lobes, such as low-lift lobes, high-lift lobes, and no-lift lobes. Mechanisms are required for switching rocker arm modes in a manner suited for operation of internal combustion engines.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A switching rocker arm assembly constructed in accordance to one example of the present disclosure includes an outer arm, an inner arm, a bearing axle, a first torsional bearing axle spring and a second torsional bearing axle spring. The outer arm has a first outer side arm and a second outer side arm. The outer arm further includes a first tang extending from the first outer side arm and a second tang extending from the second outer side arm. The outer arm defines a first slot inboard of the first tang and a second slot inboard of the second tang. The outer arm further includes a first and a second torsional spring boss. The inner arm is disposed between the first and second outer side arms. The first torsional bearing axle spring is mounted around the first torsional spring boss and has a first end nestingly received at the first slot and a second end engaged to the bearing axle.

The second torsional bearing axle spring is mounted around the second torsional spring boss and has a first end nestingly received at the second slot and a second end engaged to the bearing axle. The first ends of the first and second torsional springs are laterally constrained by the respective first and second tangs.

According to additional features, the first slot is further defined by a first end wall on the outer arm. The first end of the first torsional bearing axle spring opposes the first end wall. The first slot is defined by an inner surface of the first tang. The first end wall extends orthogonally relative to the inner surface of the first tang. The second slot is further defined by a second end wall on the outer arm. The second end of the second torsional bearing axle spring opposes the second end wall. The second slot is defined by an inner surface of the second tang. The second end wall extends orthogonally relative to the inner surface of the second tang.

According to other features, the bearing axle defines first and second grooves thereon. The second ends of the respective first and second torsional bearing axle springs are received by the first and second grooves of the bearing axle. A first bushing is arranged between the first torsional spring boss and a central mounting portion of the first torsional bearing axle spring. A second bushing is arranged between the second torsional spring boss and a central mounting portion of the second torsional bearing axle spring. The first and second slots are formed on the outer arm by one of casting and machining.

A switching rocker arm assembly constructed in accordance to another example of the present disclosure includes an outer arm, an inner arm, a bearing axle, a first torsional bearing axle spring and a second torsional bearing axle spring. The outer arm has a first outer side arm and a second outer side arm. The outer arm further includes a first tang extending from the first outer side arm and a second tang extending from the second outer side arm. The outer arm further includes a first and a second torsional spring boss. The inner arm is disposed between the first and second outer side arms. The first torsional bearing axle spring is mounted around the first torsional spring boss and has a first end laterally bound by the first tang at the first slot and a second end engaged to the bearing axle. The second torsional bearing axle spring is mounted around the second torsional spring boss and has a first end laterally bound by the second tang at the second slot and a second end engaged to the bearing axle. The first ends of the first and second torsional springs are laterally constrained by the respective first and second tangs.

According to additional features, the outer arm defines a first slot inboard of the first tang and a second slot inboard of the second tang. The first slot is further defined by a first end wall on the outer arm. The first end of the first torsional bearing axle spring opposes the first end wall. The second slot is further defined by a second end wall on the outer arm. The second end of the second torsional bearing axle spring opposes the second end wall.

According to still other features, the bearing axle defines first and second grooves thereon. The second ends of the respective first and second torsional bearing axle springs are received by the first and second grooves of the bearing axle. A first bushing is arranged between the first torsional spring boss and a central mounting portion of the first torsional bearing axle spring. A second bushing is arranged between the second torsional spring boss and a central mounting portion of the second torsional bearing axle spring. The first and second slots are formed on the outer arm by one of casting and machining.

BRIEF DESCRIPTION OF THE DRAWINGS

The present disclosure will become more fully understood from the detailed description and the accompanying drawings, wherein.

DETAILED DESCRIPTION

Figure 1:
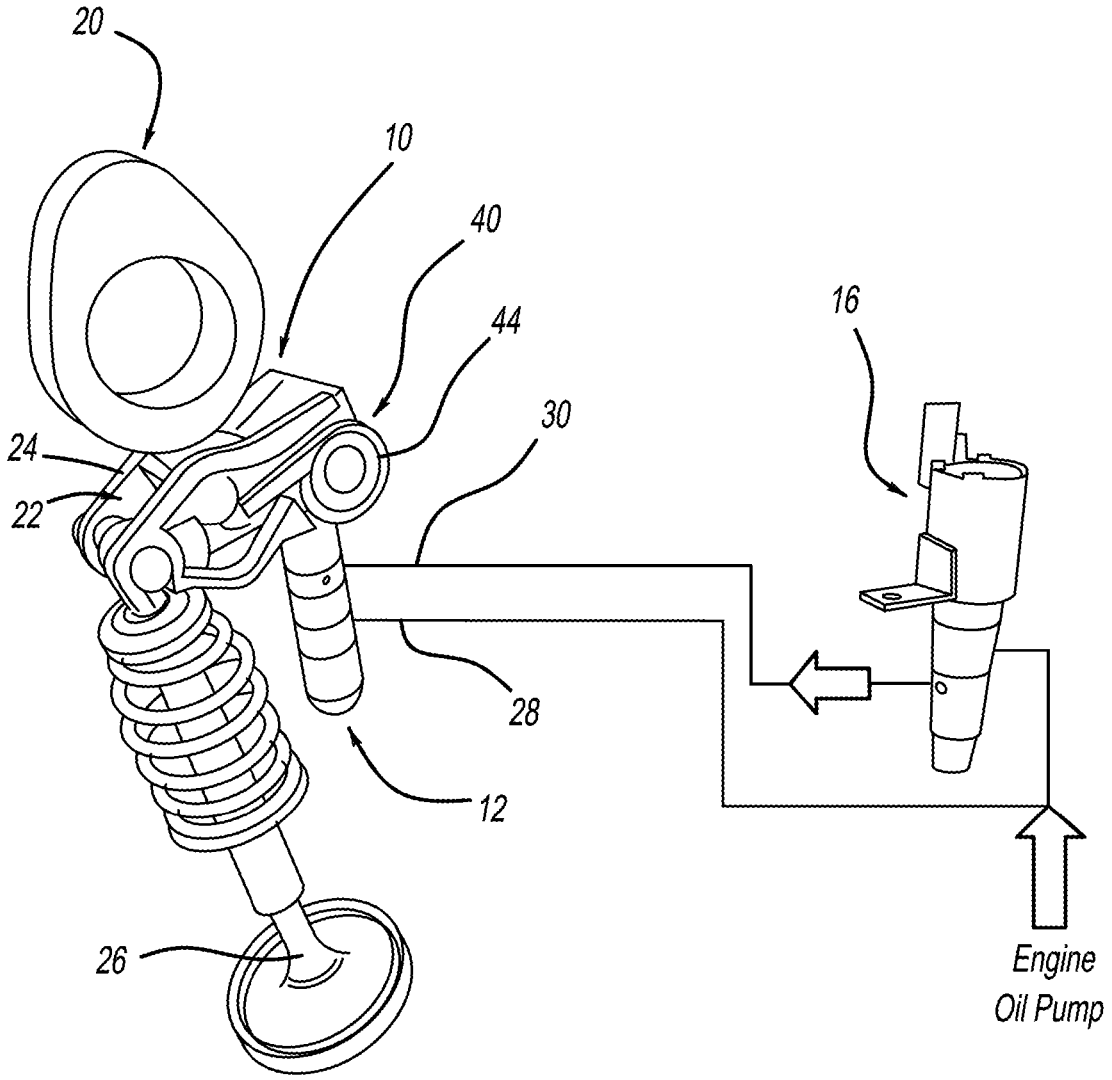
FIG - 1 Prior Art
FIG. 1 is a front perspective view of an exemplary switching rocker arm constructed in accordance to one example of prior art and incorporating a retainer.
Figure 2:
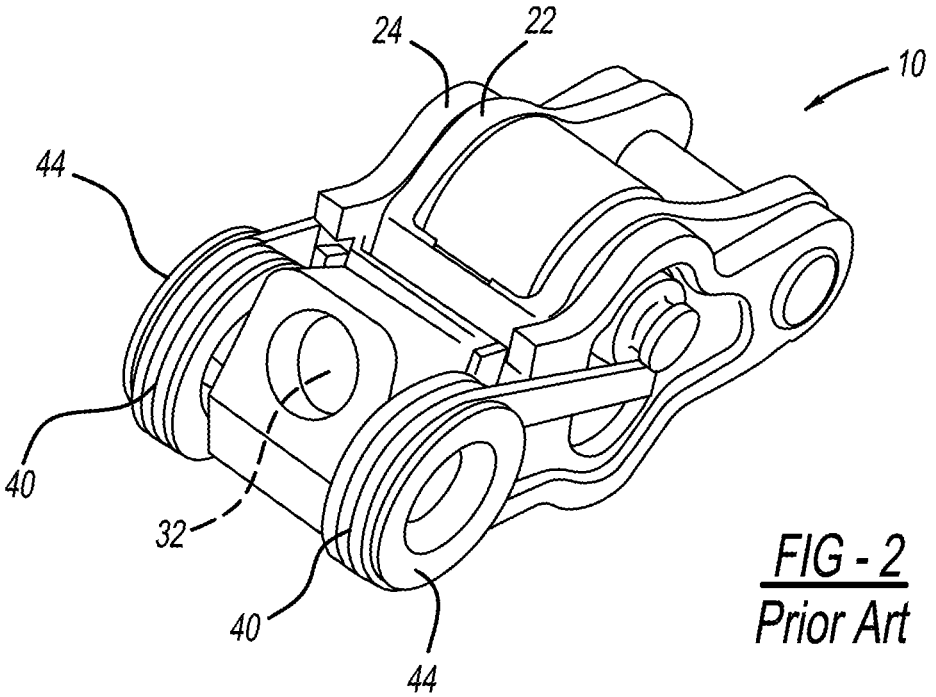
FIG - 2 Prior Art
FIG. 2 is a perspective view of the switching rocker arm of FIG. 1 constructed in accordance to one example of prior art.
Figure 3:
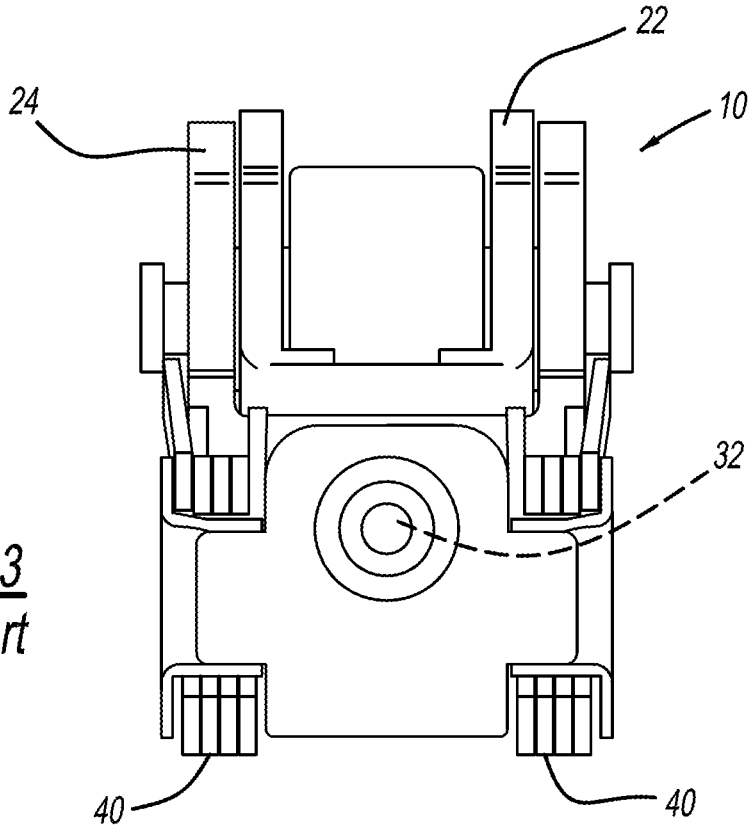
FIG - 3 Prior Art
FIG. 3 is a front view of the switching rocker arm of FIG. 2.
Figure 4:
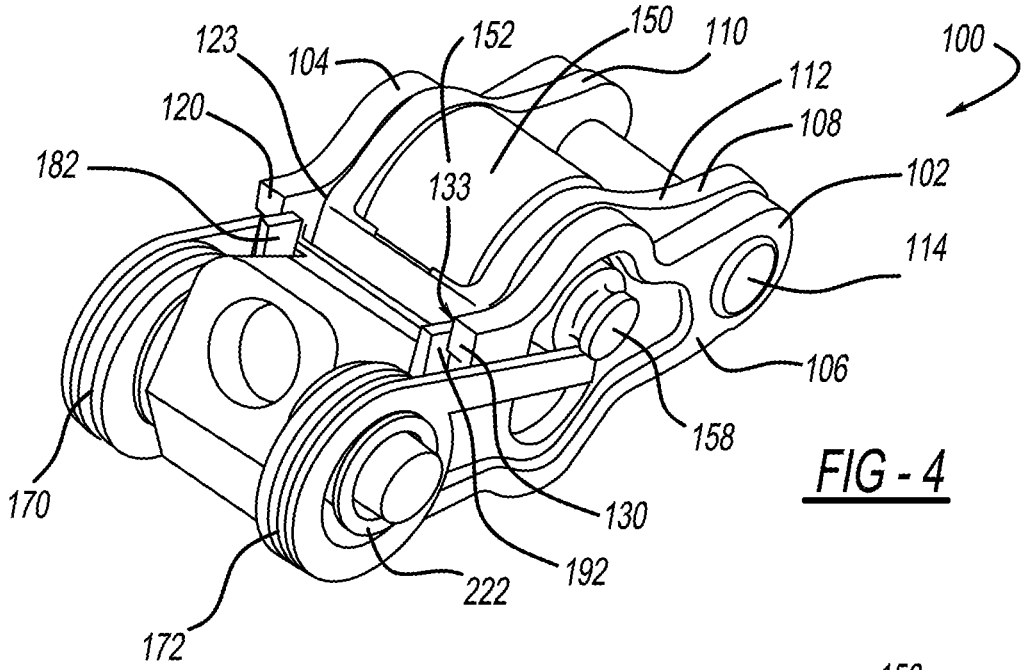
FIG. 4 is a perspective view of another switching rocker arm according to the present disclosure and incorporating a pair of slots formed in the outer rocker arm wherein first ends of the corresponding torsion springs engage the respective slots.

With initial reference to FIGS. 1-3, an exemplary switching rocker arm constructed in accordance to one example of prior art is shown and generally identified at reference 10. The switching rocker arm assembly 10 can be a compact cam-driven single-lobe cylinder deactivation (CDA-1L) switching rocker arm installed on a piston-driven internal combustion engine, and actuated with the combination of a duel-feed hydraulic lash adjusters (DFHLA) 12 and oil control valves (OCV) 16. The switching rocker arm assembly 10 can be engaged by a single lobe cam 20. The switching rocker arm assembly 10 can include an inner arm 22, an outer arm 24. The default configuration is in the normal-lift (latched) position where the inner arm 22 and the outer arm 24 are locked together, causing an engine valve 26 to open and allowing the cylinder to operate as it would in a standard valvetrain. The DFHLA 12 has two oil ports. A lower oil port 28 provides lash compensation and is fed engine oil similar to a standard HLA. An upper oil port 30, referred as the switching pressure port, provides the conduit between controlled oil pressure from the OCV 16 and a latch 32. When the latch 32 is engaged, the inner arm 22 and the outer arm 24 operate together like a standard rocker arm to open the engine valve 26. In the no-lift (unlatched) position, the inner arm 22 and the outer arm 24 can move independently to enable cylinder deactivation.

A pair of lost motion torsion springs 40 (FIG. 2) are incorporated to bias the position of the inner arm 22 so that it always maintains continuous contact with the camshaft lobe 20. The torsion springs 40 are secured to mounts located on the outer arm 24 by spring retainers 44. The spring retainers 44 retain the torsion springs 40 laterally. The lost motion torsion springs 40 require a higher preload than designs that use multiple lobes to facilitate continuous contact between the camshaft lobe 20 and an inner arm roller bearing 50.

Turning now to FIGS. 4-8, a switching rocker arm assembly constructed in accordance to one example of the present disclosure is shown and generally identified at reference number 100. The switching rocker arm assembly 100 can include an outer arm 102 having a first outer side arm 104 and a second outer side arm 106. An inner arm 108 can be disposed between the first outer side arm 104 and the second outer side arm 106. The inner arm 108 can have a first inner side arm 110 and a second inner side arm 112. The inner arm 108 and the outer arm 102 are both mounted to a pivot axle 114. The pivot axle 114 can be located adjacent to a first end of the rocker arm assembly 100, which secures the inner arm 108 to the outer arm 102 while also allowing a rotational degree of freedom pivoting about the pivot axle 114 when the rocker arm assembly 100 is in a deactivated state. In addition to the illustrated example having a separate pivot axle 114 mounted to the outer arm 102 and the inner arm 108, the pivot axle 114 may be integral to the outer arm 102 or to the inner arm 108.

The first outer side arm 104 can include a first outwardly extending tang 120. A first slot 122 (FIG. 5) can be defined by the first outer side arm 104 inboard of an inner surface 123 of the first outwardly extending tang 120. The first slot 122 can be further defined by a first end wall 124 on the outer arm 102. The first end wall 124 extends orthogonally relative to the inner surface 123 of the first outwardly extending tang 120. The second outer side arm 106 can include a second outwardly extending tang 130. A second slot 132 (FIG. 5) can be defined by the second outer side arm 106 inboard of an inner surface 133 of the second outwardly extending tang 130. The second slot 132 can be further defined by a second end wall 134 on the outer arm 102. The second end wall 134 extends orthogonally relative to the inner surface 133 of the second outwardly extending tang 130.

The rocker arm assembly 100 can include a bearing 150 having a roller 152 that is mounted between the first inner side arm 110 and the second inner side arm 112 on a bearing axle 158 that, during normal operation of the rocker arm assembly 100 serves to transfer energy from a rotating cam to the rocker arm 100. The bearing axle 158 defines grooves 160, 162 thereon.

The bearing axle 158 is biased upwardly by bearing axle springs 170 and 172. The bearing axle springs 170 and 172 are torsion springs. The bearing axle spring 170 has a central mounting portion 180, a first leg 182 and a second leg 184. The bearing axle spring 172 has a central mounting portion 190, a first leg 192 and a second leg 194. The central mounting portion 180 is received by a first outer arm torsional spring boss 210. The central mounting portion 190 of the second bearing axle spring 172 is received by a second outer arm torsional spring boss 212. A bushing 220 can be arranged between the torsional spring boss 210 and the central mounting portion 180 of the bearing axle spring 170. A bushing 222 can be arranged between the torsional spring boss 212 and the central mounting portion 190 of the bearing axle spring 172. The second legs 184 and 194 of the respective bearing axle springs 170 and 172 are both received by the respective grooves 160, 162 on the bearing axle 158.

Figure 5:
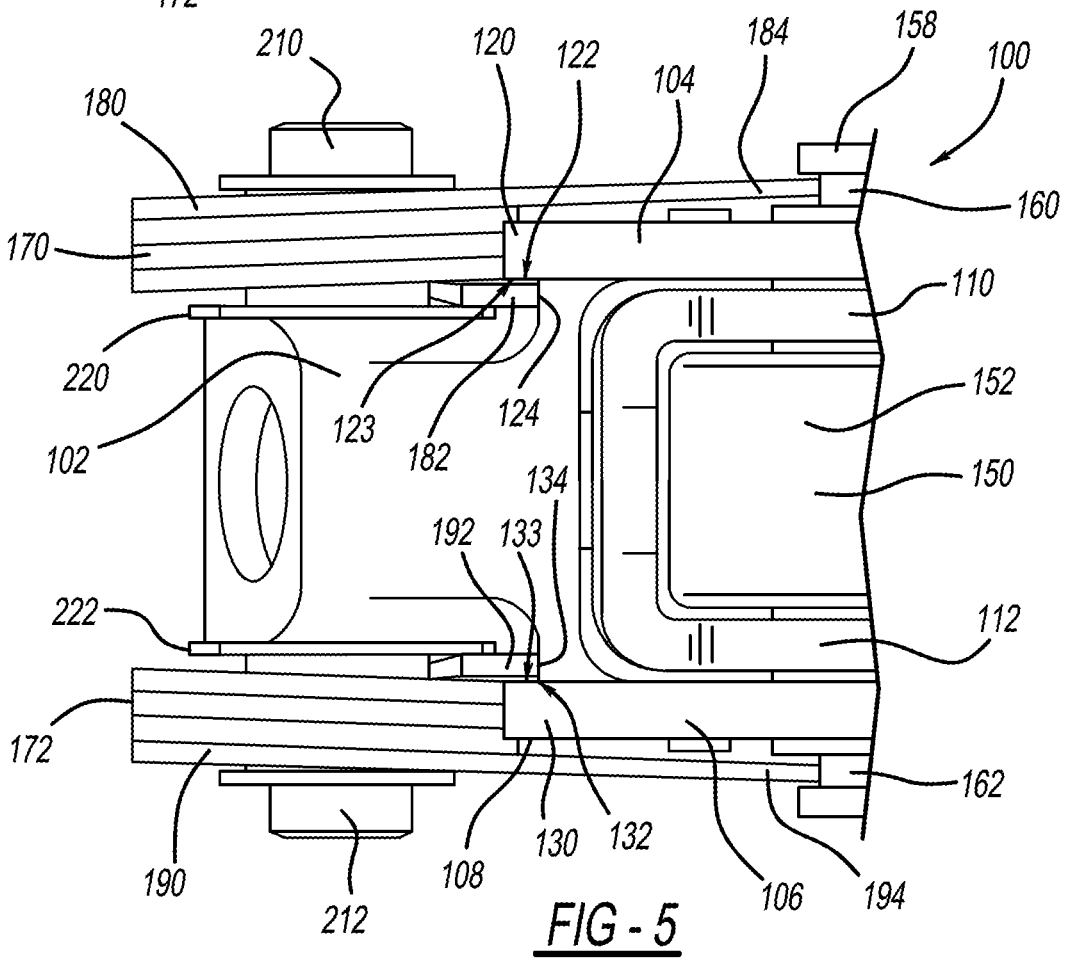
FIG. 5 a detail top view of torsion spring and slot interface of the switching rocker arm of FIG. 4.
Figure 6:
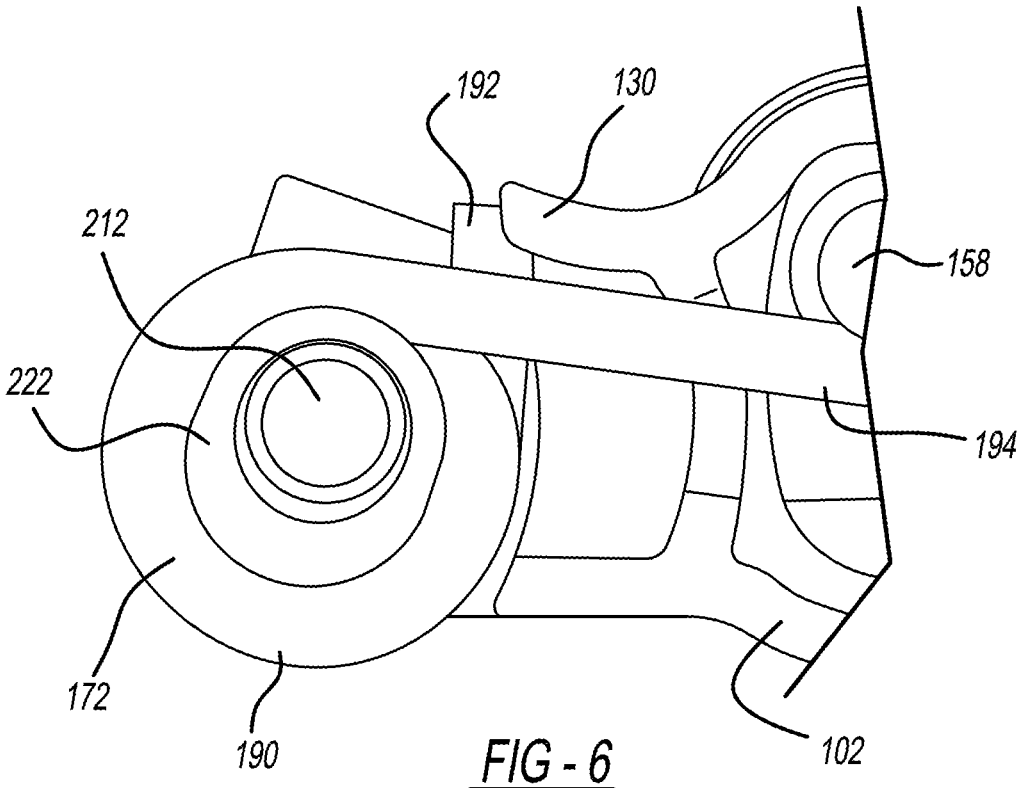
FIG. 6 is a detail side view of torsion spring and slot interface of the switching rocker arm of FIG. 4.
Figure 7:
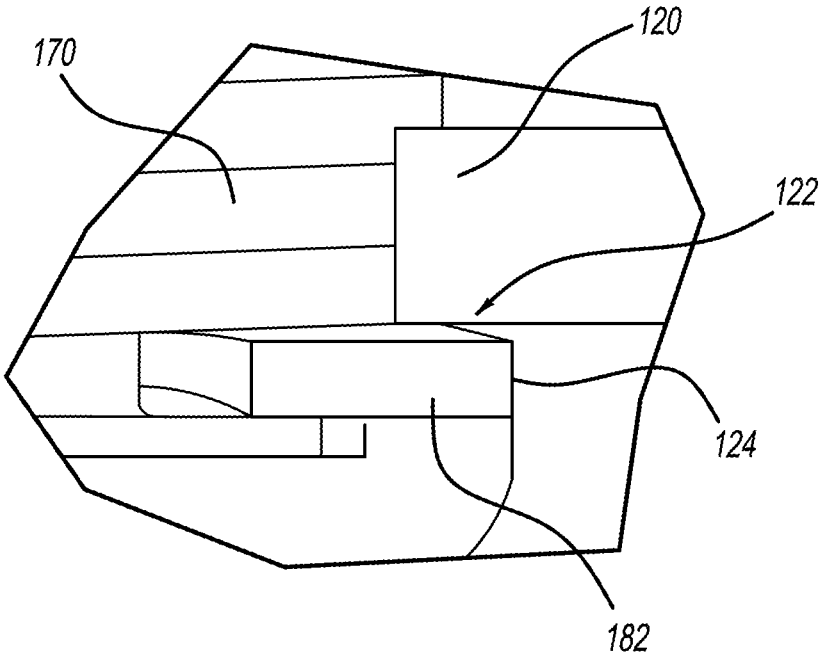
FIG. 7 is a top close-up view of the torsion spring and slot interface of the switching rocker arm of FIG. 4.
Figure 8:
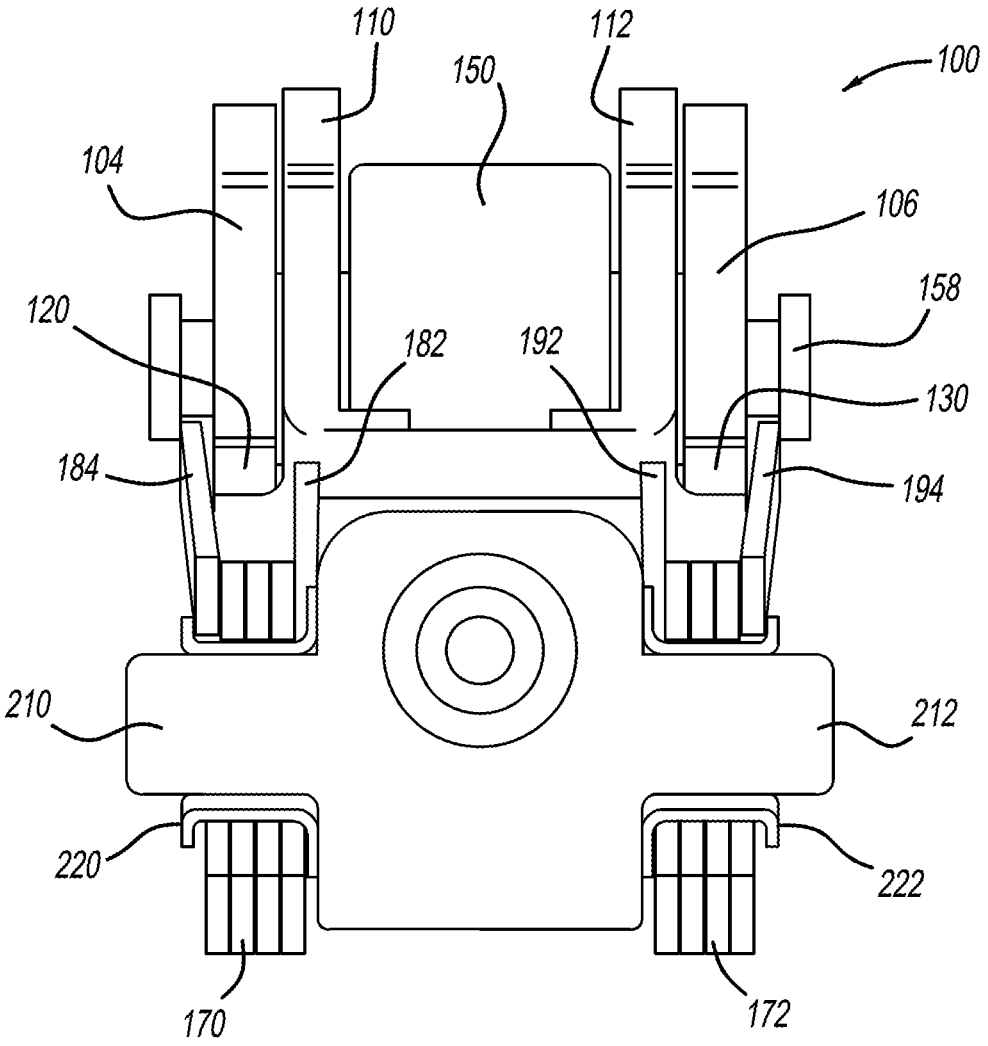
FIG. 8 is a front view of the switching rocker arm of FIG. 4 illustrating optional bushings associated with the corresponding torsion springs.

As best shown in FIG. 5, the first leg 182 of the bearing axle spring 170 is nestingly received at the first slot 122 of the first outer side arm 104 inboard of the first outwardly extending tang 120. The first leg 182 opposes the first end wall 124 on the outer arm 102. The second leg 192 of the bearing axle spring 172 is nestingly received at the second slot 132 of the outer side arm 108 inboard of the second outwardly extending tang 130. The second leg 192 opposes the second end wall 134 on the outer arm 102. The first and second legs 182 and 192 of the respective bearing axle springs 170 and 172 are constrained laterally by the tangs 120 and 130. In this regard, the configuration does not require the retainers 44 shown on the switching rocker arm assembly 10 (FIG. 2). The bushings 220 and 222 can be optionally incorporated to reduce friction between the central mounting portions 180 and 190 of the bearing axle springs 170 and 172. The bushings 220 and 222 can also be used to limit the side installed width of the spring.

The slots 122 and 132 can be incorporated on the outer rocker arm 102 by any process such as casting or machining. By utilizing the slots 122 and 132 incorporated on the outer rocker arm 102 for constraining the springs 170 and 172 from lateral movement instead of using retainers (44, FIG. 2), piece count and cost can be reduced.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A switching rocker arm assembly comprising:

an outer arm having a first outer side arm and a second outer side arm, the outer arm further including a first tang extending from the first outer side arm and a second tang extending from the second outer side arm, the outer arm defining a first slot inboard of the first tang and a second slot inboard of the second tang, the outer arm further including a first torsional spring boss extending from a first outboard facing wall of the outer arm and a second torsional spring boss extending from a second outboard facing wall of the outer arm;

an inner arm disposed between the first and second outer side arms;

a bearing axle;

a first torsional bearing axle spring mounted around the first torsional spring boss and having a first end nestingly received at the first slot and a second end engaged to the bearing axle; and a second torsional bearing axle spring mounted around the second torsional spring boss and having a first end nestingly received at the second slot and a second end engaged to the bearing axle;

wherein the first ends of the first and second torsional springs are constrained laterally outboard by the respective first and second tangs;

wherein the first end of the first torsional spring is constrained laterally inboard by the first outboard facing wall; and wherein the first end of the second torsional spring is constrained laterally inboard by the second outboard facing wall.

2. The switching rocker arm assembly of claim 1 wherein the first slot is further defined by the first outboard facing wall and a first end wall on the outer arm.

3. The switching rocker arm assembly of claim 2 wherein the first end of the first torsional bearing axle spring opposes the first end wall.

4. The switching rocker arm assembly of claim 3 wherein the first slot is defined by an inner surface of the first tang.

5. The switching rocker arm assembly of claim 4 wherein the first end wall extends orthogonally relative to the inner surface of the first tang.

6. The switching rocker arm assembly of claim 3 wherein the second slot is further defined by the second outboard facing wall and a second end wall on the outer arm.

7. The switching rocker arm assembly of claim 6 wherein the second end of the second torsional bearing axle spring opposes the second end wall.

8. The switching rocker arm assembly of claim 7 wherein the second slot is defined by an inner surface of the second tang.

9. The switching rocker arm assembly of claim 8 wherein the second end wall extends orthogonally relative to the inner surface of the second tang.

10. The switching rocker arm assembly of claim 1 wherein the bearing axle defines first and second grooves thereon.

11. The switching rocker arm assembly of claim 10 wherein the second ends of the respective first and second torsional bearing axle springs are received by the first and second grooves of the bearing axle.

12. The switching rocker arm assembly of claim 1, further comprising:

a first bushing arranged between the first torsional spring boss and a central mounting portion of the first torsional bearing axle spring; and a second bushing arranged between the second torsional spring boss and a central mounting portion of the second torsional bearing axle spring.

13. The switching rocker arm assembly of claim 1 wherein the first tang is offset from the first outboard facing wall and the second tang is offset from the second outboard facing wall when viewed in a direction normal to the first and second outboard facing walls.

14. The switching rocker arm assembly of claim 13 wherein the first end of the first torsional spring is constrained laterally inboard by the first outboard facing wall at a first lengthwise location, and the first end of the first torsional spring is constrained laterally outboard by the first tang at a second lengthwise location different than the first lengthwise location; and wherein the first end of the second torsional spring is constrained laterally inboard by the second outboard facing wall at a first lengthwise location, and the first end of the second torsional spring is constrained laterally outboard by the second tang at a second lengthwise location different than the first lengthwise location.

15. A switching rocker arm assembly comprising:

an outer arm having a first outer side arm and a second outer side arm, the outer arm further including a first tang extending from the first outer side arm and a second tang extending from the second outer side arm, the outer arm further including a first and torsional spring boss, a first outboard facing wall, and a second outboard facing wall;

the outer arm defines a first slot between the first tang and the first outboard facing wall, and a second slot between the second tang and the second outboard facing wall;

an inner arm disposed between the first and second outer side arms;

a bearing axle;

a first torsional bearing axle spring mounted around the first torsional spring boss and having a first end laterally bound by the first tang at the first slot and a second end engaged to the bearing axle; and a second torsional bearing axle spring mounted around the second torsional spring boss and having a first end laterally bound by the second tang at the second slot and a second end engaged to the bearing axle;

wherein the first ends of the first and second torsional springs are constrained by the respective first and second tangs and the first and second outboard facing walls; and wherein the first tang is offset from the first outboard facing wall and the second tang is offset from the second outboard facing wall when viewed in a direction normal to the first and second outboard facing walls.

16. The switching rocker arm assembly of claim 15 wherein the outer arm defines the first slot inboard of the first tang and the second slot inboard of the second tang.

17. The switching rocker arm assembly of claim 16 wherein the first slot is further defined by a first end wall on the outer arm and wherein the first end of the first torsional bearing axle spring opposes the first end wall.

18. The switching rocker arm assembly of claim 17 wherein the second slot is further defined by a second end wall on the outer arm and wherein the second end of the second torsional bearing axle spring opposes the second end wall.

19. The switching rocker arm assembly of claim 15 wherein the bearing axle defines first and second grooves thereon and wherein the second ends of the respective first and second torsional bearing axle springs are received by the first and second grooves of the bearing axle.

20. The switching rocker arm assembly of claim 15, further comprising:

a first bushing arranged between the first torsional spring boss and a central mounting portion of the first torsional bearing axle spring; and a second bushing arranged between the second torsional spring boss and a central mounting portion of the second torsional bearing axle spring.

* * * * *